United States Patent [19]

Haddow et al.

[11] Patent Number: 4,832,268

[45] Date of Patent: May 23, 1989

[54] IMPROVED MILL FOR GRINDING POWDER AND METHOD OF USING

[75] Inventors: Andrew J. Haddow, Middlesbrough; Trevor Carter, Yarm, both of England

[73] Assignee: Tioxide Group PLC, London, England

[21] Appl. No.: 228,746

[22] Filed: Aug. 5, 1988

[30] Foreign Application Priority Data

Sep. 5, 1987 [GB] United Kingdom ..... 8720904

[51] Int. Cl.[4] ..... B02C 19/06

[52] U.S. Cl. ..... 241/5; 241/24; 241/39; 241/42; 241/152 R

[58] Field of Search ..... 241/5, 39, 24, 38, 41, 241/42, 43, 57, 79, 152 R

[56] References Cited

U.S. PATENT DOCUMENTS

| | | | |
|---|---|---|---|
| 253,344 | 2/1882 | Chichester . | |
| 4,018,388 | 4/1977 | Andrews . | |
| 4,504,017 | 3/1985 | Andrews . | |
| 4,524,915 | 6/1985 | Yamagishi | 241/5 X |

FOREIGN PATENT DOCUMENTS

| | | |
|---|---|---|
| 2738980 | 3/1979 | Fed. Rep. of Germany . |
| 1076141 | 4/1982 | U.S.S.R. . |
| 533015 | 2/1941 | United Kingdom . |
| 592967 | 10/1947 | United Kingdom . |
| 634723 | 3/1950 | United Kingdom . |
| 645146 | 10/1950 | United Kingdom . |
| 667763 | 3/1952 | United Kingdom . |
| 671580 | 5/1952 | United Kingdom . |
| 785679 | 10/1957 | United Kingdom . |
| 1411369 | 10/1975 | United Kingdom . |
| 2045642 | 11/1980 | United Kingdom . |
| 2091127 | 7/1982 | United Kingdom . |
| 2111855 | 7/1983 | United Kingdom . |

*Primary Examiner*—Timothy V. Eley

*Attorney, Agent, or Firm*—Banner, Birch, McKie & Beckett

[57] ABSTRACT

A mill for grinding powder material is disclosed having a cylindrical separation chamber into which the powder material is fed as a dispersion in a gas stream. Powdered material initially is supplied through two spaced powder inlets each located between a jet and a venturi throat assembly so that milling fluid introduces the powder material through the venturis and the venturis are mounted in opposition so that the gas streams carrying the powder impinge on one another to impart grinding. The impinged material passes to a third venturi to be entrained in a gas fed from a third jet nozzle and introduced through the venturi into the separation chamber. The mill is of particular use for milling pigmentary powders.

16 Claims, 1 Drawing Sheet

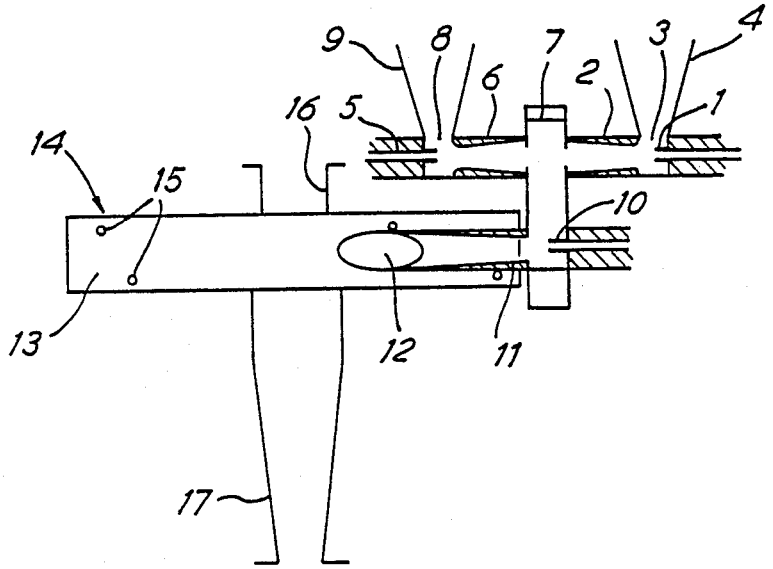
9
8
7
3
4
6
2
1
16
5
14
15
10
13
12
11
17

IMPROVED MILL FOR GRINDING POWDER AND METHOD OF USING

This invention relates to an improved mill and particularly to an improved impact mill.

According to the present invention a mill for grinding powder material comprises a powder inlet to provide powder material to be ground, a first jet nozzle for a gas, a first venturi axially in-line with said first jet nozzle and spaced therefrom by said powder inlet, a second jet nozzle for a gas and a second venturi axially in line with said second jet nozzle and a further powder inlet between said second jet nozzle and second venturi, said first and second venturis being mounted in opposition with a mixing chamber between them, a third jet nozzle for a gas in said mixing chamber and having a longitundinal axis in a plane substantially parallel to that of the axis of said first jet and of said first venturi, a cylindrical separation chamber having a circumferential wall and having outlets for exhaust gas and powder material and and feeding means extending through said circumferential wall comprising a third venturi axially in line with said third jet nozzle to introduce powder material from said mixing chamber into said cylindrical separation chamber.

Whilst the mill includes said cylindrical separation chamber it is to be understood that this chamber can also act as a fluid energy mill through impact of powder particles with one another and, if desired, additional gaseous material can be supplied to said chamber through one or more gas jets.

As will be seen the mill of the present invention is a combination of an impact mill formed by two opposed jet/venturi assemblies with a third jet nozzle assembly which acts to entrain the powder material from the opposed assemblies in a second gas stream and feed this stream to the separation chamber where additional milling can be effected. The presence of the third jet nozzle increases the flow of particulate material through the mill by reducing the pressure on the discharge side of the impacted jet streams from the opposed jet/venturi assembly.

The mill is of particular use in grinding powder material to a small controlled size range and particularly for those types of powders, such as pigments, where properties of the product can be changed according to the product size.

Inorganic pigments such as titanium dioxide, silica, silicates, aluminium oxide, antimony pigments, calcium pigments, carbon black, iron oxide, lead oxide, zinc oxide, zirconia are all suitable for grinding in the improved mill. Other materials such as organic coloured pigments and pharmaceuticals can be ground in the mill employing a suitable grinding gas.

The mill constructed in accordance with the invention can have any convenient chosen size so as to produce a desired rate of output of milled powder and accordingly is suitable in any particular chosen form for use as a laboratory mill or up to a full sized factory unit. The particular sizes of the jet nozzles, the venturis and cylindrical chamber depend on the desired output of milled powder as does the rate of feed or grinding or carrier gas through the particular jet nozzles.

The jet nozzles and associated venturi throats can have sizes chosen from within a wide size range and the gases fed through the nozzles can be fed under a wide range of pressures chosen to match the particular jet sizes and production characteristics required. One particular form of preferred mill constructed in accordance with the invention has a ratio of throat area of the first-/second venturi to the area of the first/second jet nozzle respectively of about 11:1 and a ratio of the third venturi throat area to third jet area of about 16:1 for operation at about 20 bars pressure.

Any suitable gas can be used to entrain and transport material to be milled through the mill. Steam or an inert gas can be used as can air. The gas can be heated if desired and in the case of steam the degree of super heat chosen governs the temperature of the gas employed. Generally speaking the gases fed to the jet nozzles will have a pressure of at least 5 bars and preferably have a pressure of at least 10 bars.

It will be seen that the first and second jet nozzle and throat assemblies are mounted in opposition so that they feed into a mixing chamber. The two feeds impinge on another and the third jet/throat assembly is provided in said mixing chamber in a plane substantially parallel to that of the axis of the first jet/throat assembly. The mixed feed from the first and second jet/throat assemblies is entrained in the mixing chamber in the gas stream from the third jet nozzle and passed into the third venturi throat.

It will be seen that separate supplies of gas are fed to the first, second and third nozzles and in a particular arrangement the rate of feed is such that the third nozzle is supplied with gas flowing at a rate up to twice that flowing in total to the first and second nozzles.

If desired an additional supply of gas is introduced into the separation chamber through one or more inlets extending through the circumferential wall of the chamber. The total amount of gas fed to the separation chamber through these additional inlets through the circumferential wall can be substantially equal to that supplied to the mill through the first jet nozzle or less.

The mill in accordance with the present invention can be constructed of any appropriate material such as stainless steel or indeed the various parts of the particular mill can be formed of ceramic material if desired.

One form of mill constructed in accordance with the invention will now be described by way of example only with reference to the accompanying drawings in which FIG. 1 is a diagrammatic view showing part in sectional elevation.

As shown in FIG. 1 the mill consists of a first jet nozzle 1 axially aligned but spaced from a first venturi 2. Between the nozzle 1 and venturi 2 is an inlet 3 for powder material from a hopper 4. A second jet nozzle 5 is mounted axially aligned and spaced from a second venturi 6 mounted in opposition to the first venturi 2 on a mixing chamber 7. An inlet 8 is provided between the second nozzle 5 and venturi 6 for powder from a hopper 9.

The mixing chamber 7 receives material from the venturis 2 and 6 and the powder passes to a third jet nozzle 10 and through a third venturi 11 axially aligned with the jet nozzle 10. The third venturi 11 forms a powder feed device to feed powder through a powder inlet 12 in the wall 13 of a cylindrical chamber 14.

The cylindrical wall 13 of a cylindrical chamber 14 is provided with a number of spaced gas inlets 15 directed to feed additional quantities of gas into the cylindrical chamber 14. The cylindrical chamber 14 is provided with a centrally located gas offtake 16 opposite an axially aligned milled powder offtake 17.

In operation the powder material to be ground is fed from hopper 4 through the feed inlet 3 and becomes entrained in gas supplied through jet nozzle 1. The gas together with the entrained material is fed through venturi 2 and directed into the mixing chamber 7 together with powder form the second jet nozzle 5 and second venturi 6. Gas flowing from the third jet nozzle 10 entrains the material in the chamber 7 due to the influence of the second venturi 7 a reduction in pressure occurs together with a positive increase in the rate of flow of the powdered material to be ground from hoppers 4 and 9. The material after entrainment and passage through the third venturi 11 is fed substantially tangentially into the cylindrical chamber 14 through the feed inlet 12 where additional supplies of gas can be introduced through the gas inlets 15 augumenting the flow of gas within within the chamber 14 and increasing the milling effect occurring therein due to impact of the particles with each other. As the gaseous fluid and milled particles are transported towards the central regions of the chamber 14 the speed of the flowing gas becomes insufficient to support the milled particles which exit the chamber through the particle offtake 17 and exhaust gas together with any very small particle size material exhaust through the gas exhaust 16.

In a specific example titanium dioxide pigment at a total rate of 220 kg per hour was fed equally at a rate of 110 kg per hour to each of the opposed first and second jet nozzles 1 and 6. Each nozzle was supplied with steam at a rate of 72 kg per hour and a pressure of 20 bars gauge. 237 kg per hour of steam at the same pressure was fed to the third jet nozzle 10. No steam was fed to the grinding jets 15. The overall steam/pigment ratio was 1.7:1.

The product obtained compared favourably with that obtained after double milling in a standard fluid energy mill.

The experiment was repeated with steam at a rate of 145 kg per hour and at a pressure of 20 bars gauge being fed to the jets 15. No change in pigment quality was seen.

We claim:

1. A method of milling which comprises establishing a mill comprising a powder inlet to provide powder material to be ground, a first jet nozzle for a gas, a first venturi axially in-line with said first jet nozzle and spaced therefrom by said powder inlet, a second jet nozzle for a gas and a second venturi axially in-line with said second jet nozzle and a further powder inlet between said second jet nozzle and second venturi, said first and second venturis being mounted in opposition with a mixing chamber between them, a third jet nozzle for a gas in said mixing chamber and having a longitudinal axis in a plane substantially parallel to that of the axis of said first jet and of said first venturi, a cylindrical separation chamber having a circumferential wall and having outlets for exhaust gas and powder material and feeding means extending through said circumferential wall comprising a third venturi axially in line with said third jet nozzle to introduce powder material from said mixing chamber into said cylindrical separation chamber and introducing a powder material to be ground through said powder inlets and a gas through said first, second and third jet nozzles and collecting said ground powder material.

2. A method of milling according to claim 1 in which the gas employed is air.

3. A method of milling according to claim 1 in which the gas employed is steam.

4. A method of milling according to claim 1 in which the gas employed is an inert gas.

5. A method of milling according to claim 1 in which the gas employed is heated.

6. A method of milling according to claim 1 in which the gas fed to the jet nozzles has a pressure of at least 5 bars.

7. A method of milling according to claim 1 in which the gas fed to the jet nozzles has a pressure of at least 10 bars.

8. A method of milling according to claim 1 in which the rate of feed of gas is such that the third jet nozzle is supplied with gas flowing at a rate of up to twice that flowing in total to the first and second nozzles.

9. A method of milling according to claim 1 in which the ratio of the throat area of the third venturi to the area of the third jet nozzle is about 16:1 and gas is fed to the said nozzles at a pressure of about 20 bar.

10. A method of milling according to claim 1 in which the powder material to be ground is titanium dioxide pigment.

11. A mill for grinding powder material comprising a powder inlet to provide powder material to be ground, a first jet nozzle for a gas, a first venturi axially in-line with said first jet nozzle and spaced therefrom by said powder inlet, a second jet nozzle for a gas and a second venturi axially in-line with said second jet nozzle and a further powder inlet between said second jet nozzle and second venturi, said first and second venturis being mounted in opposition with a mixing chamber between them, a third jet nozzle for a gas in said mixing chamber and having a longitudinal axis in a plane substantially parallel to that of the axis of said first jet and of said first venturi, a cylindrical separation chamber having a circumferential wall and having outlets for exhaust gas and powder material and feeding means extending through said circumferential wall comprising a third venturi axially in line with said third jet nozzle to introduce powder material from said mixing chamber into said cylindrical separation chamber.

12. A mill according to claim 11 in which the ratio of throat area of the first/second venturi to the area of the first/second jet nozzle respectively is about 11:1.

13. A mill according to claim 11 in which the ratio of the throat area of the third venturi to the area of the third jet nozzle is about 16:1.

14. A mill according to claim 11 in which said cylindrical separation chamber has one or more inlets for a gas extending through the circumferential wall of the chamber.

15. A mill according to claim 11 in which the mill is constructed of stainless steel.

16. A mill according to claim 11 in which the mill comprises a ceramic material.

* * * * *